US010959584B1

(12) United States Patent
Mathias et al.

(10) Patent No.: US 10,959,584 B1
(45) Date of Patent: Mar. 30, 2021

(54) REPLACEMENT HEAD FOR A VACUUM

(71) Applicant: SharkNinja Operating LLC, Needham, MA (US)

(72) Inventors: Richard Mathias, Needham, MA (US); Brandon J. Suleski, Cambridge, MA (US); Michael Douglas, London (GB)

(73) Assignee: SHARKNINJA OPERATING LLC, Needham, MA (US)

( * ) Notice: Subject to any disclaimer, the term of this patent is extended or adjusted under 35 U.S.C. 154(b) by 0 days.

(21) Appl. No.: 16/670,319

(22) Filed: Oct. 31, 2019

(51) Int. Cl.
*A47L 9/10* (2006.01)
*A47L 9/12* (2006.01)
*A47L 9/06* (2006.01)

(52) U.S. Cl.
CPC ..... *A47L 9/0673* (2013.01); *A47L 9/066* (2013.01); *A47L 9/0626* (2013.01); *A47L 9/0666* (2013.01); *A47L 9/122* (2013.01)

(58) Field of Classification Search
None
See application file for complete search history.

(56) References Cited

U.S. PATENT DOCUMENTS

| | | | |
|---|---|---|---|
| 490,472 | A | 1/1893 | Clements |
| D117,388 | S | 10/1939 | Woinarovicz |
| D214,977 | S | 8/1969 | Roth |
| D247,949 | S | 5/1978 | Tillinghast et al. |
| D250,245 | S | 11/1978 | Bebb |
| D278,099 | S | 3/1985 | Evans |
| 5,365,881 | A | 11/1994 | Sporn |
| 5,664,285 | A | 9/1997 | Melito et al. |
| 5,829,090 | A | 11/1998 | Melito et al. |
| D423,157 | S | 4/2000 | Hodges |
| 6,102,278 | A | 8/2000 | Rothas |
| 6,453,506 | B1 | 9/2002 | Summer |
| 6,571,421 | B1 | 6/2003 | Sham et al. |
| 6,966,098 | B2 | 11/2005 | Sako et al. |

(Continued)

FOREIGN PATENT DOCUMENTS

| | | | |
|---|---|---|---|
| CN | 103356140 | A | 10/2013 |
| CN | 205181229 | U | 4/2016 |

(Continued)

OTHER PUBLICATIONS

Amazon.com—Shark Genius Steam Pocket Mop Hard Floor Cleaner, oldest reviews 2016, https://www.amazon.com/Cleaner-Blaster-Technology-Intelligent-S5003D/dp/B01 KU4BSGK/ref=cm_cr arp_d_product_top?ie=UTF8, site visited Oct. 11, 2018.

(Continued)

*Primary Examiner* — Brian D Keller
(74) *Attorney, Agent, or Firm* — Dilworth IP, LLC

(57) ABSTRACT

A replacement head for a vacuum device includes a plastic tray, a filter and a pad. The plastic tray includes a dust chamber and a front guard portion. An opening is provided that allows air, dust and debris to be drawn into the dust chamber during use. The front guard portion preferably has at least a portion that has a triangular cross-sectional shape and defines an interior space. The pad is attached to the lower side of the plastic tray and is in contact with the floor during cleaning. The filter is connected to the plastic tray such that the filter substantially covers a top opening in the dust chamber.

26 Claims, 21 Drawing Sheets

(56) References Cited

U.S. PATENT DOCUMENTS

| | | | | |
|---|---|---|---|---|
| 6,979,371 | B1 * | 12/2005 | Policicchio | C11D 3/30 134/39 |
| 7,013,528 | B2 | 3/2006 | Parker et al. | |
| 7,048,804 | B2 | 5/2006 | Kisela et al. | |
| 7,137,169 | B2 | 11/2006 | Murphy et al. | |
| 7,150,069 | B2 | 12/2006 | Hori et al. | |
| D548,907 | S | 8/2007 | Killen | |
| 7,293,322 | B2 | 11/2007 | Matousek et al. | |
| 7,329,294 | B2 | 2/2008 | Conrad | |
| 7,337,494 | B2 | 3/2008 | Baer et al. | |
| 7,409,745 | B2 | 8/2008 | Dodson et al. | |
| D597,717 | S | 8/2009 | Rosenzweig et al. | |
| 7,673,361 | B2 | 3/2010 | Policicchio et al. | |
| 7,676,877 | B2 | 3/2010 | Policicchio et al. | |
| 7,861,351 | B2 | 1/2011 | Ho | |
| 7,934,287 | B2 | 5/2011 | De Soto-Burt et al. | |
| 8,020,236 | B2 | 9/2011 | Kaleta et al. | |
| 8,065,778 | B2 | 11/2011 | Kim et al. | |
| D661,034 | S | 5/2012 | Ediger et al. | |
| D672,107 | S | 12/2012 | Van Landingham, Jr. et al. | |
| 8,341,802 | B2 | 1/2013 | Kim et al. | |
| 8,458,850 | B2 | 6/2013 | Kasper et al. | |
| 8,495,781 | B2 | 7/2013 | Dingert | |
| D703,407 | S | 4/2014 | Xiong | |
| D731,137 | S | 6/2015 | Colangelo | |
| D764,127 | S | 8/2016 | Vicari et al. | |
| D766,584 | S | 9/2016 | Blouin et al. | |
| 9,504,366 | B2 | 11/2016 | Kasper et al. | |
| 9,661,968 | B2 | 5/2017 | Bradbury | |
| D804,123 | S | 11/2017 | Orsino | |
| 9,901,231 | B2 | 2/2018 | Tibberts | |
| D817,574 | S | 5/2018 | Libman et al. | |
| 2003/0159230 | A1 | 8/2003 | Oh | |
| 2004/0045126 | A1 | 3/2004 | Parker et al. | |
| 2004/0134016 | A1 | 7/2004 | Kisela et al. | |
| 2004/0134025 | A1 | 7/2004 | Murphy et al. | |
| 2004/0141798 | A1 | 7/2004 | Garabedian, Jr. et al. | |
| 2005/0115409 | A1 | 6/2005 | Conrad | |
| 2005/0193516 | A1 | 9/2005 | Hughes | |
| 2007/0245511 | A1 | 10/2007 | Hahm et al. | |
| 2010/0024156 | A1 * | 2/2010 | De Soto-Burt | A47L 5/28 15/347 |
| 2010/0024157 | A1 | 2/2010 | Vernon et al. | |
| 2010/0115719 | A1 | 5/2010 | West et al. | |
| 2012/0311813 | A1 | 12/2012 | Gilbert, Jr. et al. | |
| 2013/0055521 | A1 | 3/2013 | Lee et al. | |
| 2014/0033470 | A1 | 2/2014 | Codling | |
| 2014/0033471 | A1 | 2/2014 | Toole et al. | |
| 2016/0174793 | A1 | 6/2016 | Burke et al. | |
| 2017/0007086 | A1 | 1/2017 | Kleine-Doepke et al. | |
| 2017/0202421 | A1 | 7/2017 | Hwang et al. | |
| 2018/0035855 | A1 | 2/2018 | Wood | |
| 2018/0055315 | A1 | 3/2018 | Conrad | |
| 2018/0177367 | A1 | 6/2018 | Amaral et al. | |
| 2018/0220861 | A1 | 8/2018 | Zhang et al. | |
| 2019/0075984 | A1 | 3/2019 | James et al. | |
| 2019/0274496 | A1 | 9/2019 | James et al. | |
| 2019/0274497 | A1 | 9/2019 | James et al. | |
| 2019/0274498 | A1 | 9/2019 | James et al. | |
| 2019/0282045 | A1 | 9/2019 | James et al. | |

FOREIGN PATENT DOCUMENTS

| | | | |
|---|---|---|---|
| EP | 1027844 | A2 | 8/2000 |
| JP | 2006198083 | A | 8/2006 |
| JP | D1489801 | S | 2/2014 |
| KR | 20170043227 | A | 4/2017 |
| WO | 2004062454 | A2 | 7/2004 |
| WO | 2004062457 | A2 | 7/2004 |
| WO | 2005018402 | A2 | 3/2005 |
| WO | 2010014366 | A1 | 2/2010 |
| WO | 2010014367 | A1 | 2/2010 |
| WO | 2011017493 | A1 | 2/2011 |
| WO | 2011112545 | A2 | 9/2011 |
| WO | 2014020303 | A1 | 2/2014 |
| WO | 2014104503 | A1 | 7/2014 |
| WO | 2016022270 | A1 | 2/2016 |
| WO | 2016062647 | A1 | 4/2016 |
| WO | 2016095040 | A1 | 6/2016 |
| WO | 2016100964 | A2 | 6/2016 |
| WO | 2019051431 | A1 | 3/2019 |

OTHER PUBLICATIONS

International Search Report; Application No. PCT/US2018/050308; dated Nov. 26, 2018; 3 pages.

* cited by examiner

REPLACEMENT HEAD FOR A VACUUM

FIELD OF THE INVENTION

The present disclosure relates generally to replacement heads for cleaning devices, and more specifically to replacement heads for certain vacuum devices.

BACKGROUND

Hardfloor cleaning can be challenging when there are a variety of mixed media debris present. In some instances, there is a desire to both vacuum dry, loose debris, scrub stuck debris and absorb any wet debris that may be present. Prior art tools, such as vacuums, dry mops and wet mops are capable of handling some of these types of media, but not all at once. As a result, many often sweep dry debris before mopping wet or stuck-on debris.

Known tools that can handle both dry and wet media have higher set-up times than a broom/mop combination and the after-use maintenance can be especially high when liquids are involved. If the combination tool is not properly cleaned after each use, they can become smelly and unpleasant. Lastly, clean up can be quite messy and the user may be required to either dirty his or her hands and/or wear gloves.

Therefore, an improved hardfloor cleaner that can be easily attached and detached to a vacuum device with minimal effort and mess is desired.

SUMMARY

According to one aspect of the invention, the replacement head includes a filter, a plastic tray and a pad. The plastic tray includes a dust chamber, and a front guard portion. The dust chamber defines a top opening bounded by a sealing surface. The dust chamber also has a bottom wall, a front wall, a rear wall, a left wall and a right wall. The bottom wall of the dust chamber defines an exterior bottom surface. An opening extends through at least one of the walls (preferably, the front wall) into the dust chamber just behind the front guard portion. The pad includes at least one layer of material and defines a first surface and a second surface. The first surface is connected to bottom wall of the plastic tray and the second surface generally faces away from the first surface. The filter is connected to the plastic tray such that the filter substantially covers the top opening. The front guard portion is integrally formed with the plastic tray and has a bottom surface that has a lowest point that is closer to the second surface of the pad than the sealing surface According to another aspect of the invention, at least one portion of the front guard portion has a cross-sectional shape that is generally triangular.

According to a further aspect of the invention, the front guard portion defines at least one interior space located below the sealing surface and adjacent the dust chamber.

According to an even further aspect of the invention, the front guard portion extends in front of at least a portion of the opening and, in some embodiments, extends to the outside of one or both sides of the opening.

According to an even further aspect of the invention, the front guard portion includes at least one castellation.

One advantage of the present invention is that the user can easily remove and replace a soiled replacement head with a fresh replacement head in a short amount of time with very little mess.

DETAILED DESCRIPTION OF THE INVENTION

Figure 1:
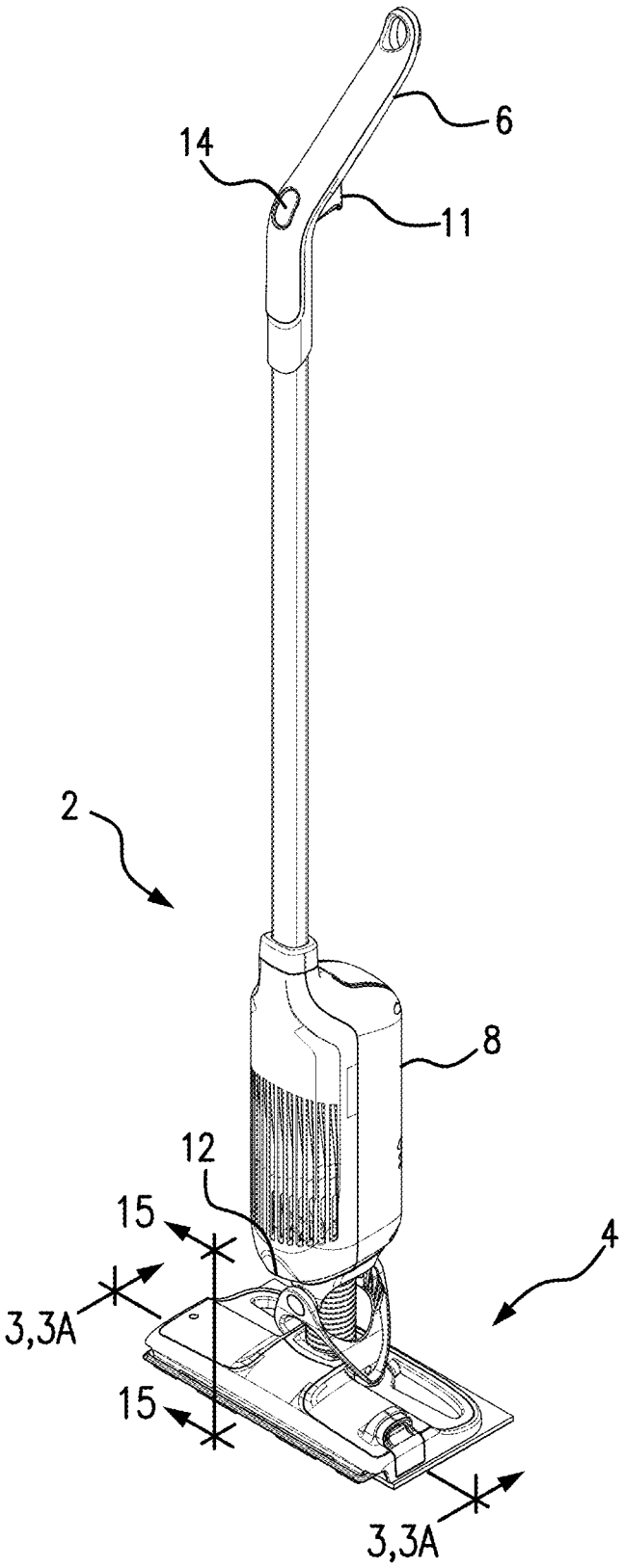
FIG. 1 shows an isometric view of a vacuum device and replacement head of the present invention.
Figure 2:
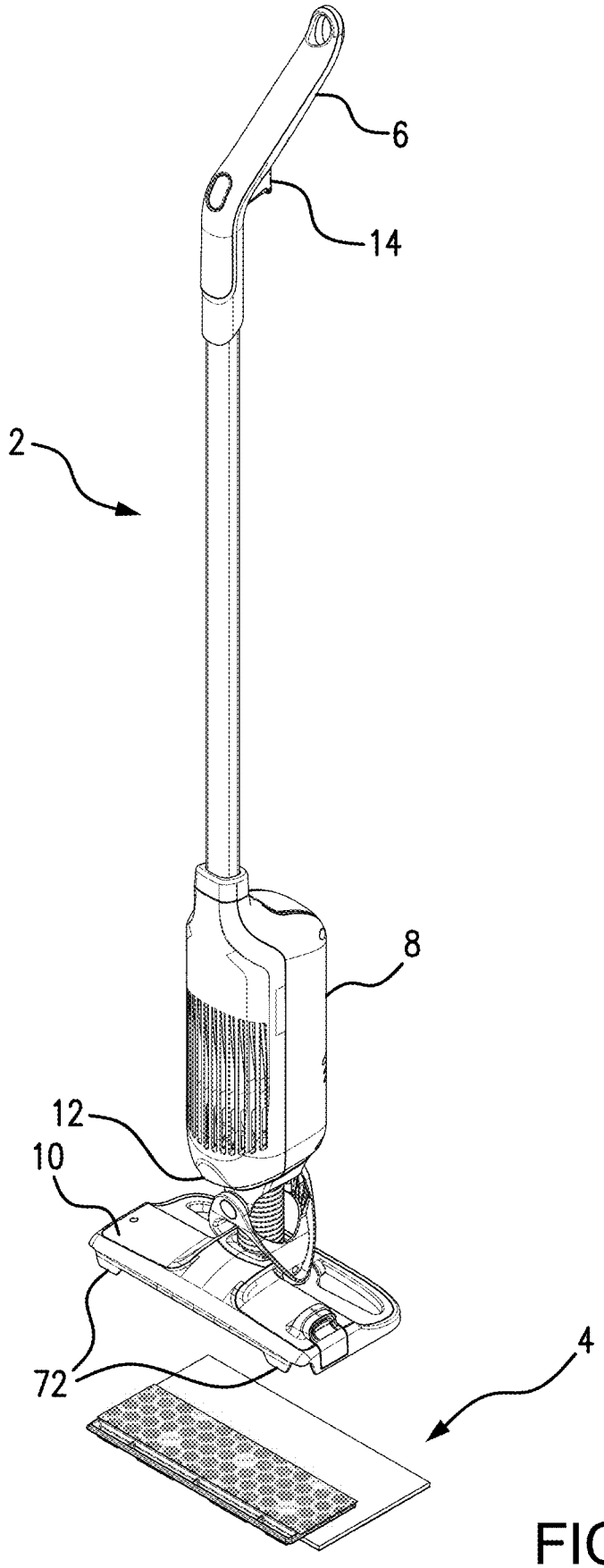
FIG. 2 shows an isometric view of the vacuum device and replacement head of FIG. 1 separated from one another.
Figure 3:
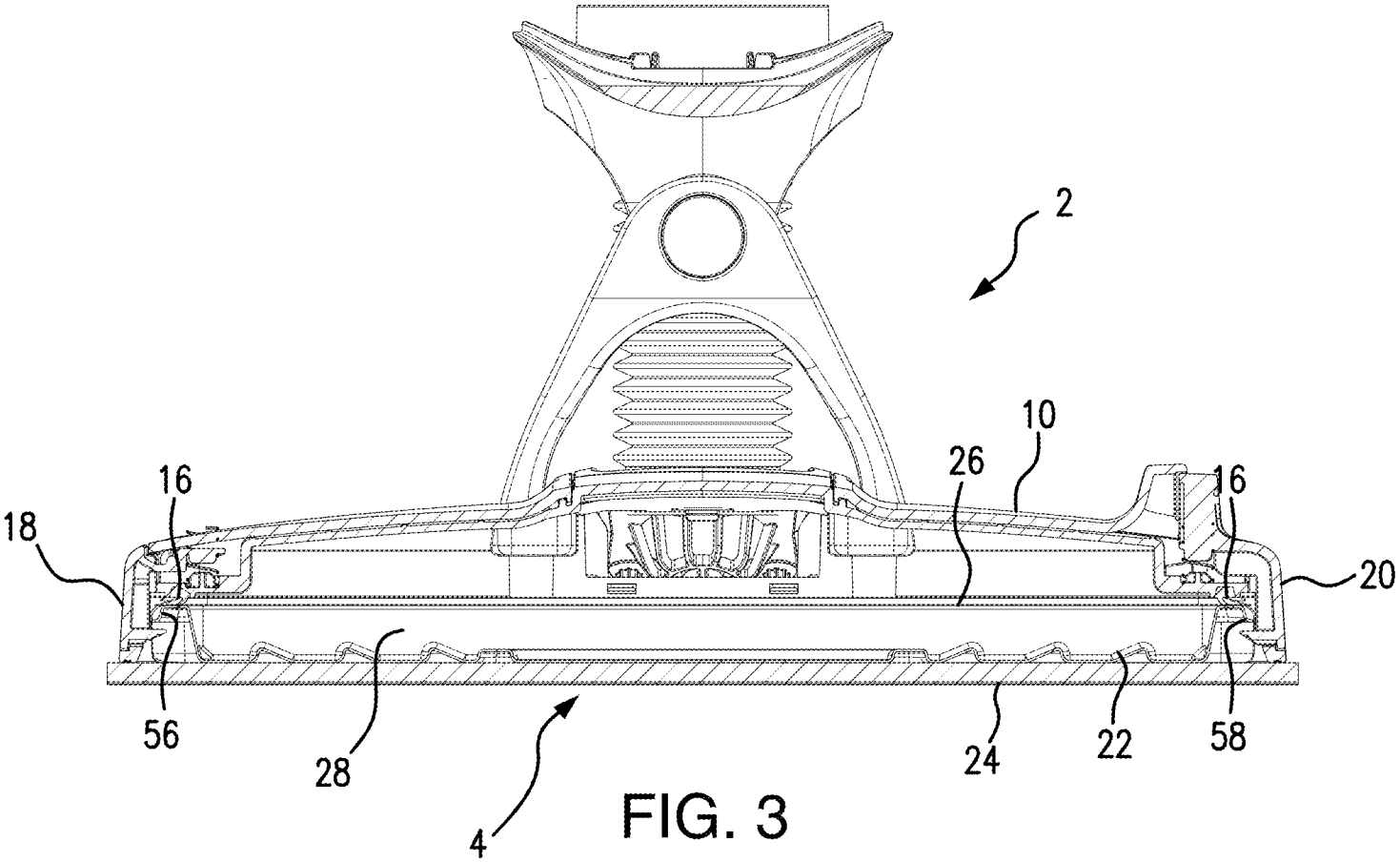
FIG. 3 shows a cross-sectional view of FIG. 1 along line 3-3 showing the vacuum head and replacement head attached and with connector arms in the locked position.
Figure 3A:
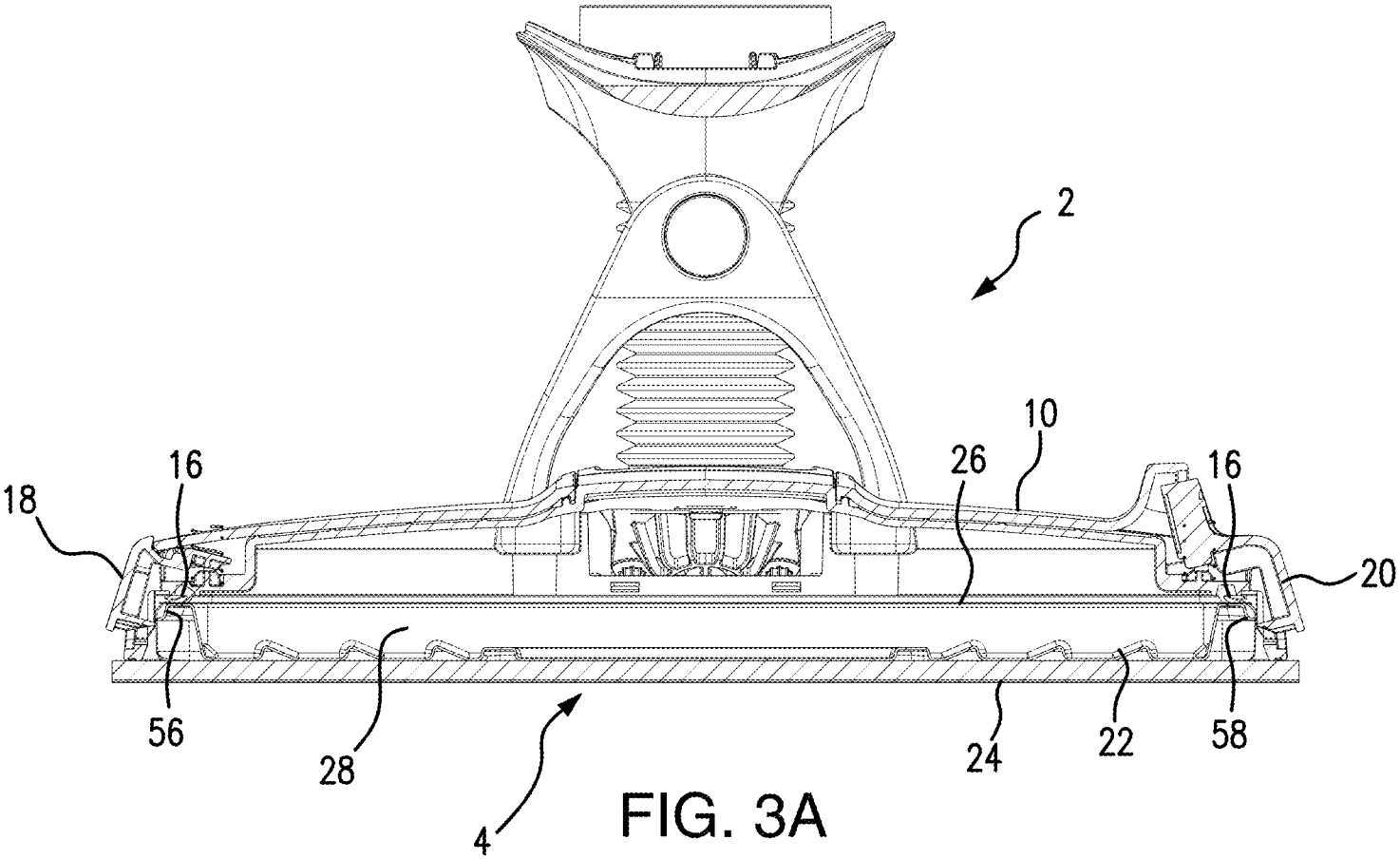
FIG. 3A shows a cross-sectional view of FIG. 1 along line 3A-3A showing the vacuum head and replacement head attached and with a connector arm in the open position.

FIGS. 1 and 2 illustrate a perspective view of a vacuum device 2 and a replacement head 4 that can be selectively attached and detached. The vacuum device 2 includes a handle 6, a vacuum body 8 that includes a suction source (not visible), a vacuum head 10, and a trigger 11 for selectively activating the suction source. The vacuum device 2 may also include a container for holding a fluid (e.g., a cleaning fluid), a jet nozzle 12 and a user-activated button 14 to selectively spray the fluid from the jet nozzle 12. The jet nozzle 12 is preferably aimed to spray fluid from the jet nozzle 12 to a position in front of the replacement head 4 when the button 14 is activated by the user during normal use. Referring now to FIGS. 3 and 3A, the vacuum head 10 includes a vacuum sealing surface 16 and at least two connector arms 18, 20. In the embodiment shown, at least one the connector arms 18 are movable between a closed position (FIG. 3) and an open position (FIG. 3A).

Figure 4:
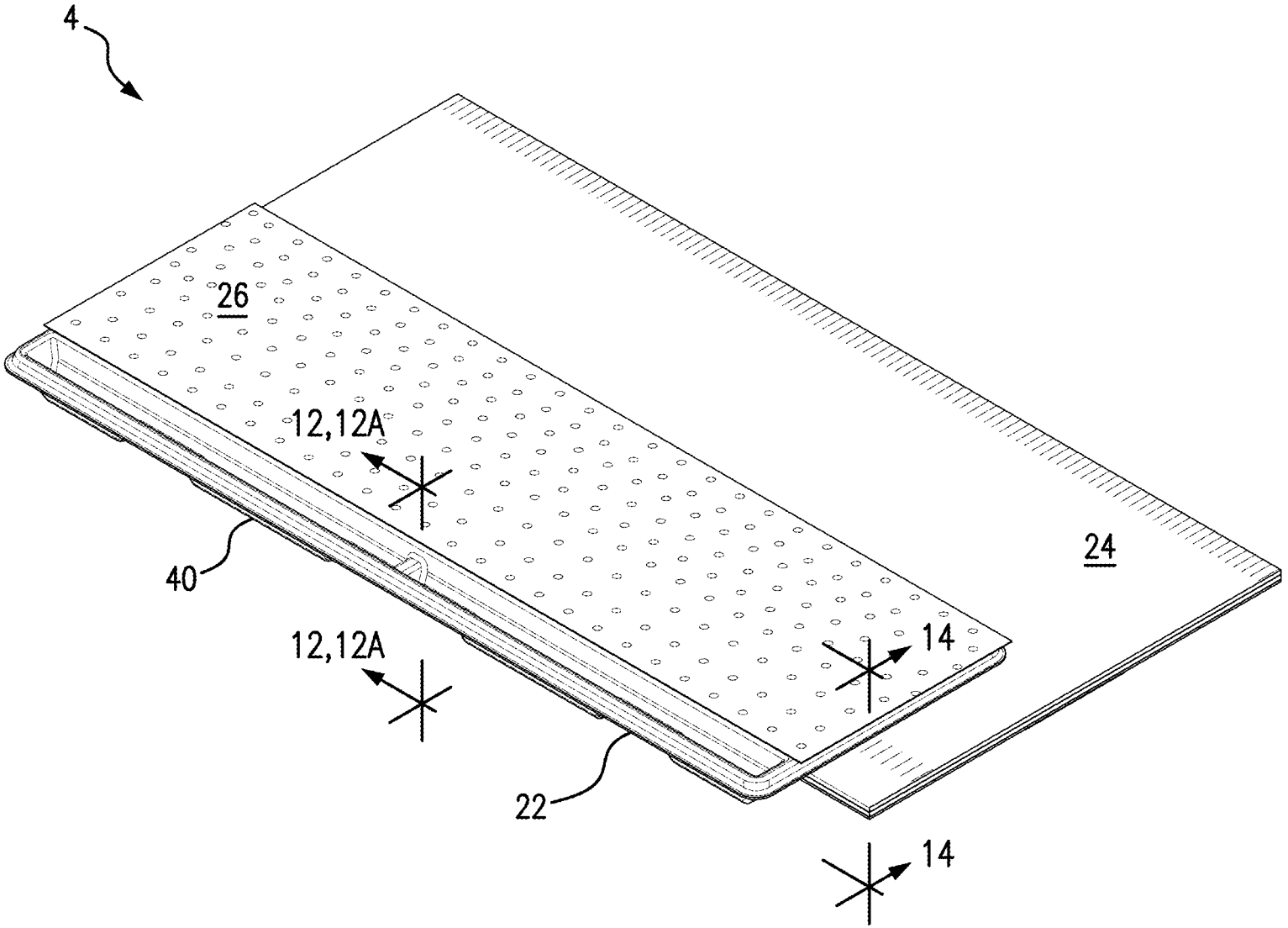
FIG. 4 shows an isometric view of the replacement head of the present invention.
Figure 5:
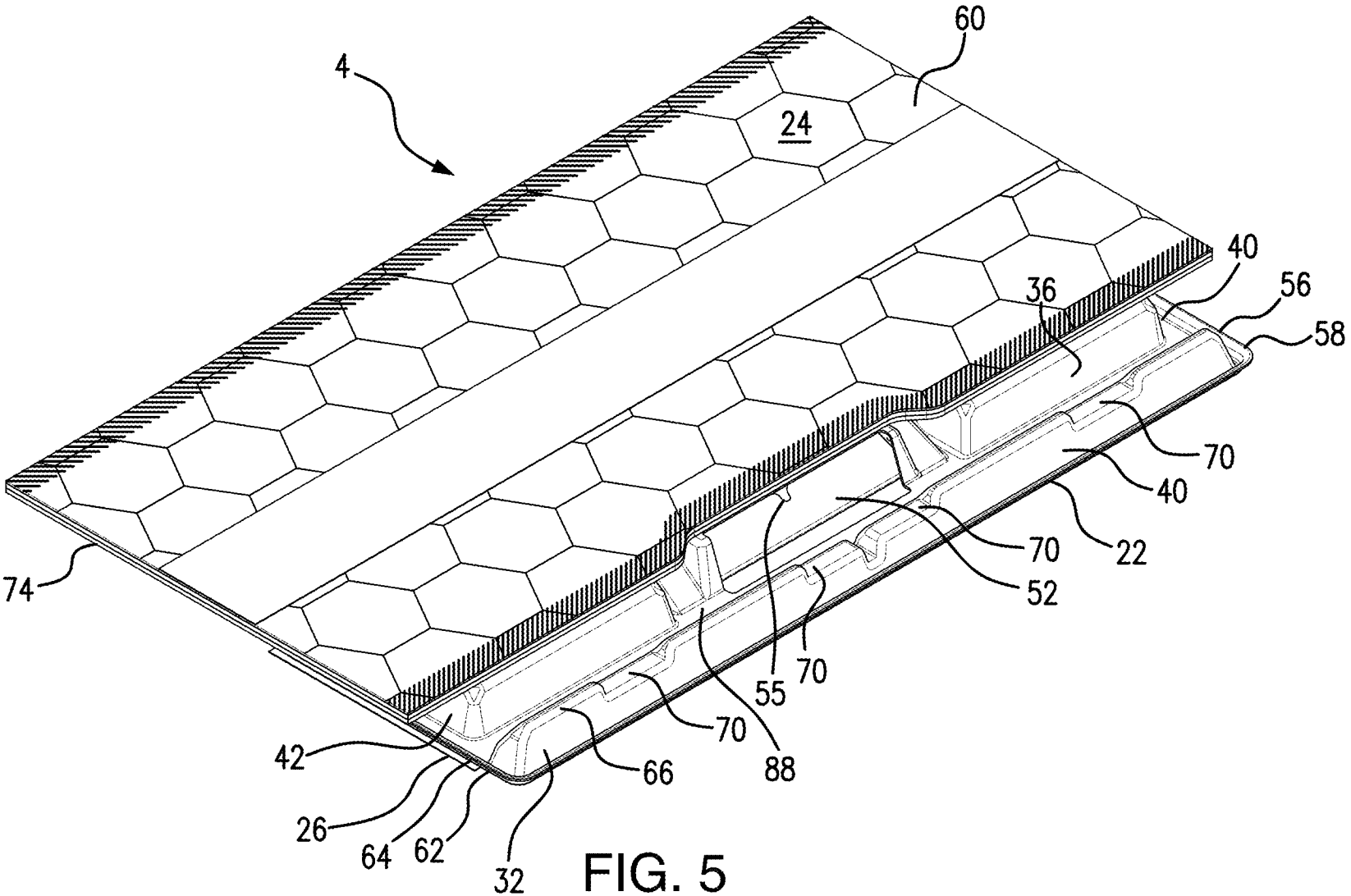
FIG. 5 shows an isometric view of the replacement head of FIG. 4 from a different angle.
Figure 6:
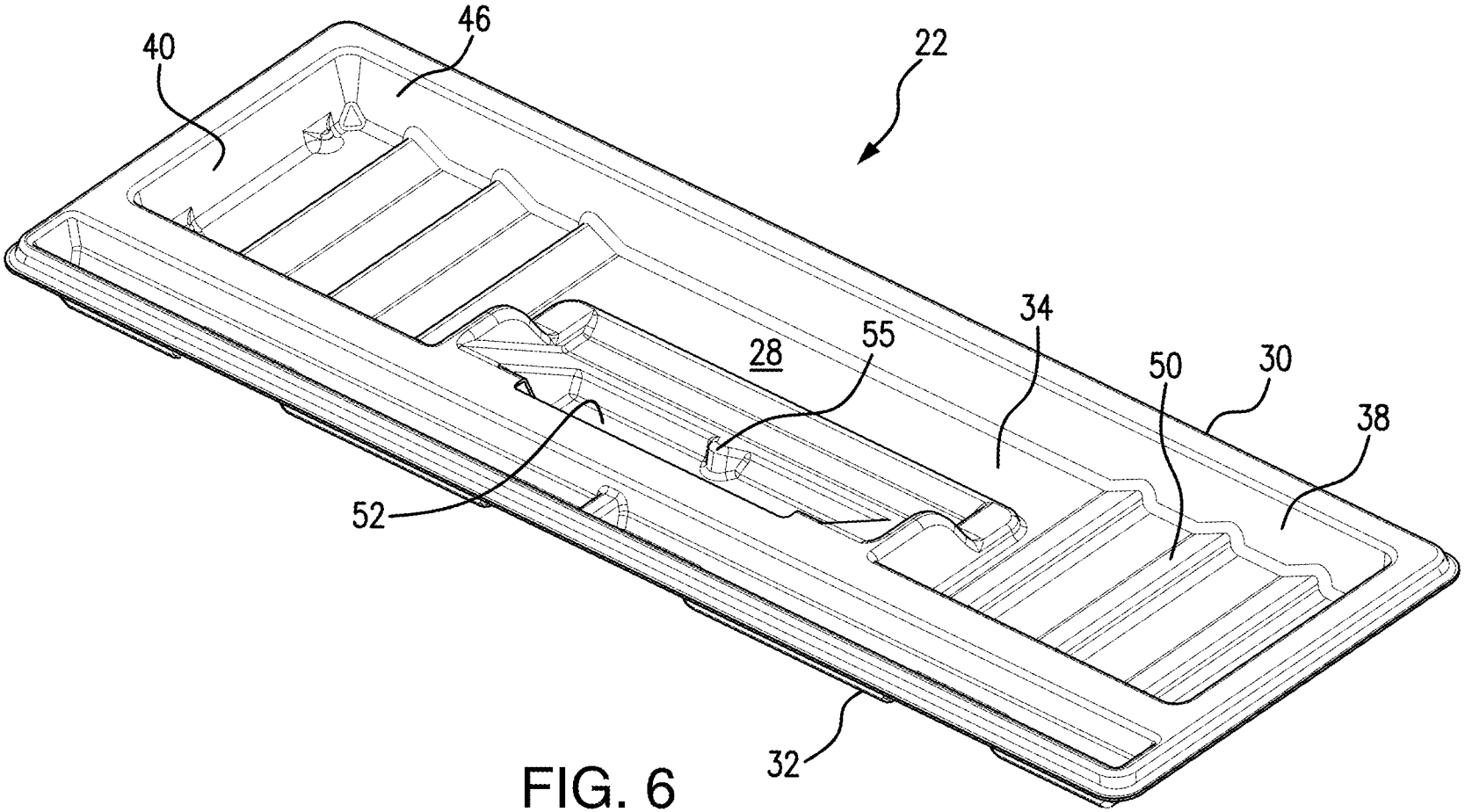
FIG. 6 shows an isometric view of the plastic tray of the present invention.

Referring now to FIGS. 4-6, the replacement head 4 includes a plastic tray 22, a pad 24, and a filter 26. The plastic tray 22 includes a dust chamber 28, a sealing surface 30 (see e.g., FIG. 6) and a front guard portion 40.

The plastic tray 22 can be made of any suitable material (including non-plastics); however, materials that are inexpensive and readily disposable are preferred. For example, polyethylene terephthalate (or "PET") is considered a preferred material, in part, because PET is inexpensive and is readily thermoformed to the desired shape. Injection molding, blow molding or any other common manufacturing processes would also be acceptable and appropriate alternatives. As shown, the plastic tray 22 can be formed of a single, unitary piece, or can be comprised of two or more parts that are connected or joined during the assembly of the replacement head 4.

Figure 9:
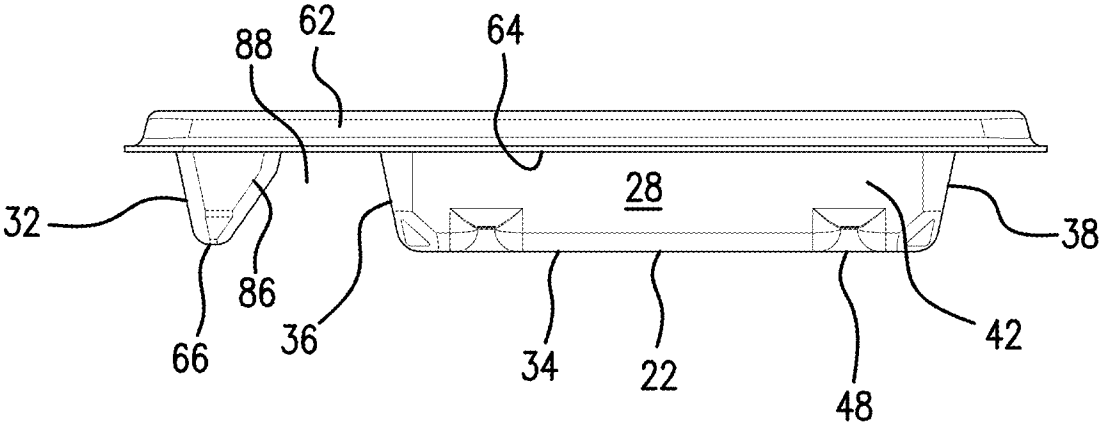
FIG. 9 shows a side view of the plastic tray of the present invention.
Figure 10:
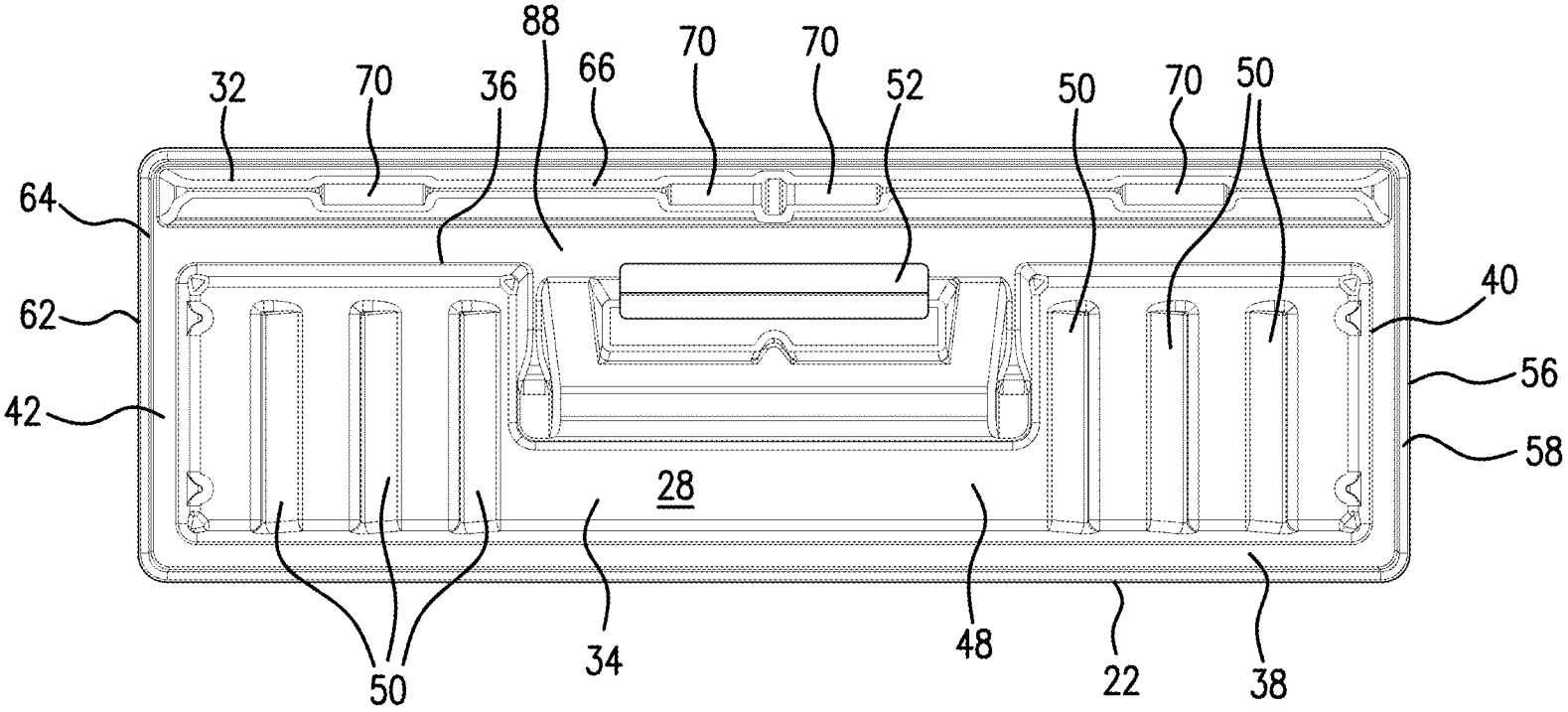
FIG. 10 shows a bottom view of the plastic tray of the present invention.

The plastic tray 22 as shown in FIGS. 6-12 includes a dust chamber 28 that is sized and shaped to collect and retain dust and debris that is suctioned into the plastic tray 22 during use. In the embodiment shown, the dust chamber 28 has a bottom wall 34, a front wall 36, a rear wall 38, a left wall 40, and a right wall 42. At the top of the dust chamber 28 is a top opening 46. Together, the walls and the top opening 46 generally define a volume of space capable of collecting and retaining common household dust and debris. One of skill in the art would understand that varying the size and shape of the walls and top opening 46 would increase or decrease the overall volume of the dust chamber without departing from the spirit of the invention. Although the rear wall 38, and left and right walls 40, 42 are shown as generally straight in FIGS. 9 and 10, the walls can include at least one curve or bend, or include other features that make them not straight. For example, the front wall 36, as shown in FIG. 10, includes a series of curves and features. The curves and bends, among other benefits, increase the structural stability without increasing the thickness of the material. The bottom wall 34 defines a bottom surface 48 and may include ridges 50 (see FIGS. 8 and 10) to assist with retaining dust in place that has collected at the bottom of the dust chamber 28 during use. Alternatively, the bottom wall 34 can be generally flat.

Referencing now to FIGS. 3, 3A, 6 and 11, a sealing surface 30 extends circumferentially around the top opening 46 of the plastic tray 28. The sealing surface 30 is complementary to a vacuum sealing surface 16 on the vacuum head 10. The sealing surface 30 and the vacuum sealing surface 16 are either directly or (preferably) indirectly in contact with one another during use. In a preferred embodiment, where the sealing surface 30 and the vacuum surface 16 are indirectly in contact, the filter 26 may be sandwiched therebetween during use (see e.g., FIG. 3). To facilitate an effective seal that prevents a loss of suction during use, the sealing surface must be held in place with sufficient enough force against the vacuum sealing surface. In the embodiment shown, the sealing surface is a generally rectangular ring with a generally flat surface. The term generally rectangular is intended to describe a shape with a width greater than a length. However, the shape is not intended to be limited to a precise rectangle. For example, as shown in e.g., FIG. 10, the generally rectangular shape includes corners that are rounded. Other embodiments could have chamfered corners, or non-straight sidewalls.

Figure 11:
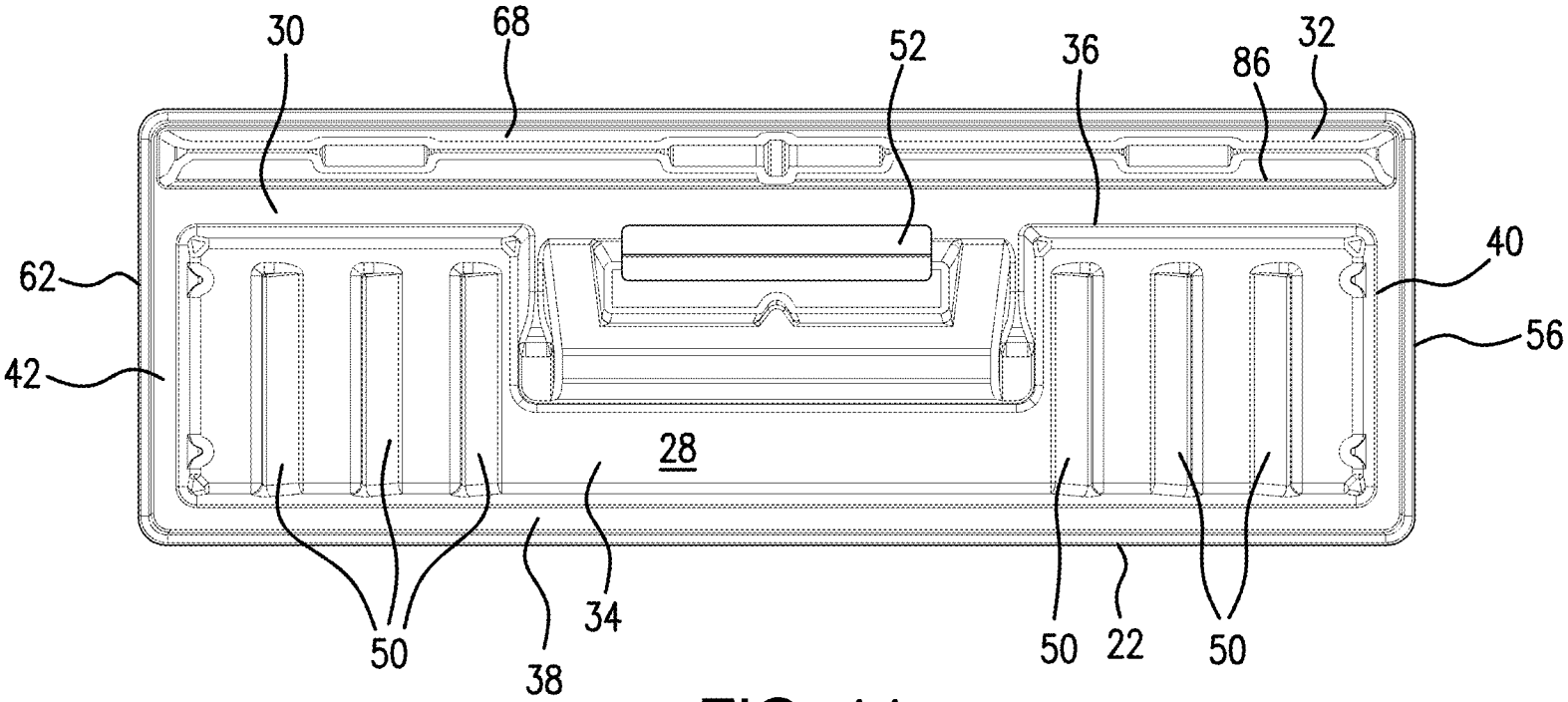
FIG. 11 shows a top view of the plastic tray of the present invention.

Referring to FIGS. 5, 10 and 11, at least one opening 52 exists that enables air, dust and debris to be drawn in from a position outside the replacement head 4 into the dust chamber 28 during use. In a preferred embodiment, a single rectangular-shaped opening 52 is located on the front wall 36 of the dust chamber 28. One of skill in the art would understand that alternative embodiments, although not shown, could include: multiple openings on a single wall; an opening that extends over two or more adjacent walls; at least opening on one wall, and another opening on another wall; or any combination of the above alternatives.

The opening 52 is preferably covered by an opening cover 54. The opening cover 54 can be made of any suitable material; however, in a preferred embodiment the material is either spunbond polypropylene, 1.25 oz and extruded PET, 0.7 Mil, or 80 gsm spunbond PP. Preferably, the opening cover 54 is a cantilevered flap that, when open (FIG. 12A), permits air, dust and debris to enter into the dust chamber and, when closed (FIG. 12), generally covers the opening 52 to retain collected dust and debris within the dust chamber 28. While the cantilevered flap described above is a cost-effective solution, alternatives can include, for example, an opening cover 54 that is made of plastic or metal. The opening cover 54 is, preferably, attached to the underside of the filter 26. However, although not shown, the opening cover 54 can, for example, be attached to the plastic tray. In addition, while the preferred embodiment generally relies on the flexibility and resiliency of the opening cover 54 material employed, the opening cover 54 can also employ a hinge that defines a pivot axis, or a living hinge.

In some embodiment, and now referring FIG. 5, the opening may further include an opening rib 55. The opening rib 55 is preferably integral with the dust chamber 28 and provides a stop surface to prevent the opening cover 54 from becoming either stuck in the opening 52 or from exiting the opening 52 during either shipment or normal use.

Figure 13:
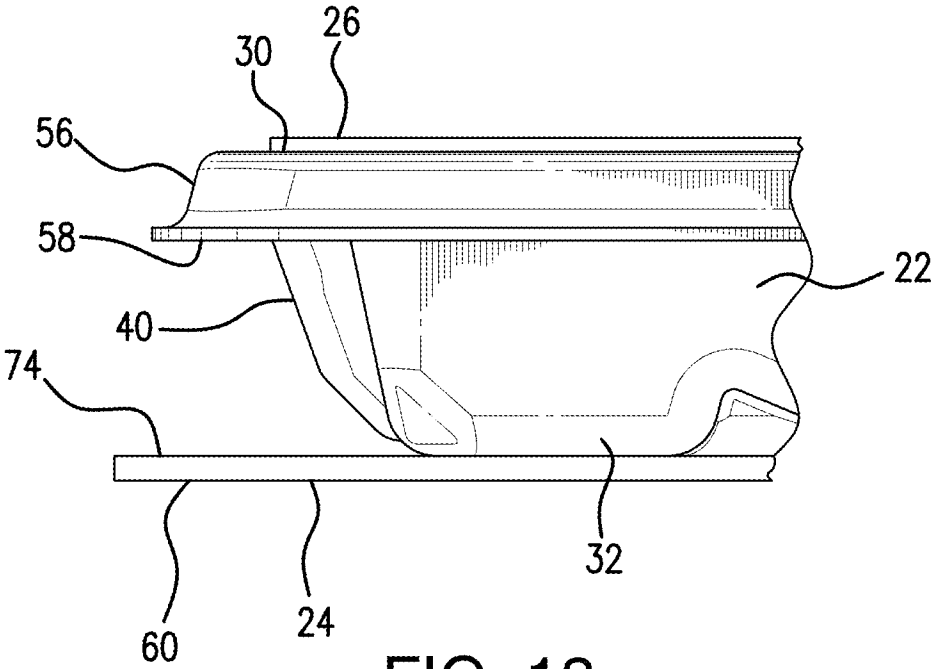
FIG. 13 shows an enlarged front view of one side of the replacement head.
Figure 14:
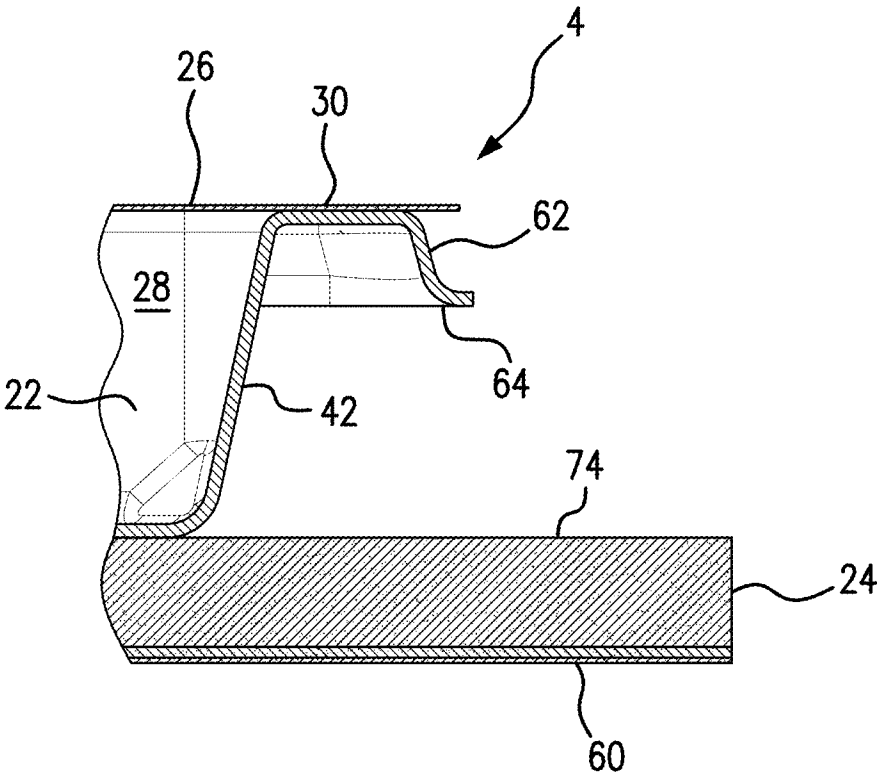
FIG. 14 shows a cross-sectional view of FIG. 4 along line 14-14 depicting the shape of the first connector lip.
Figure 15:
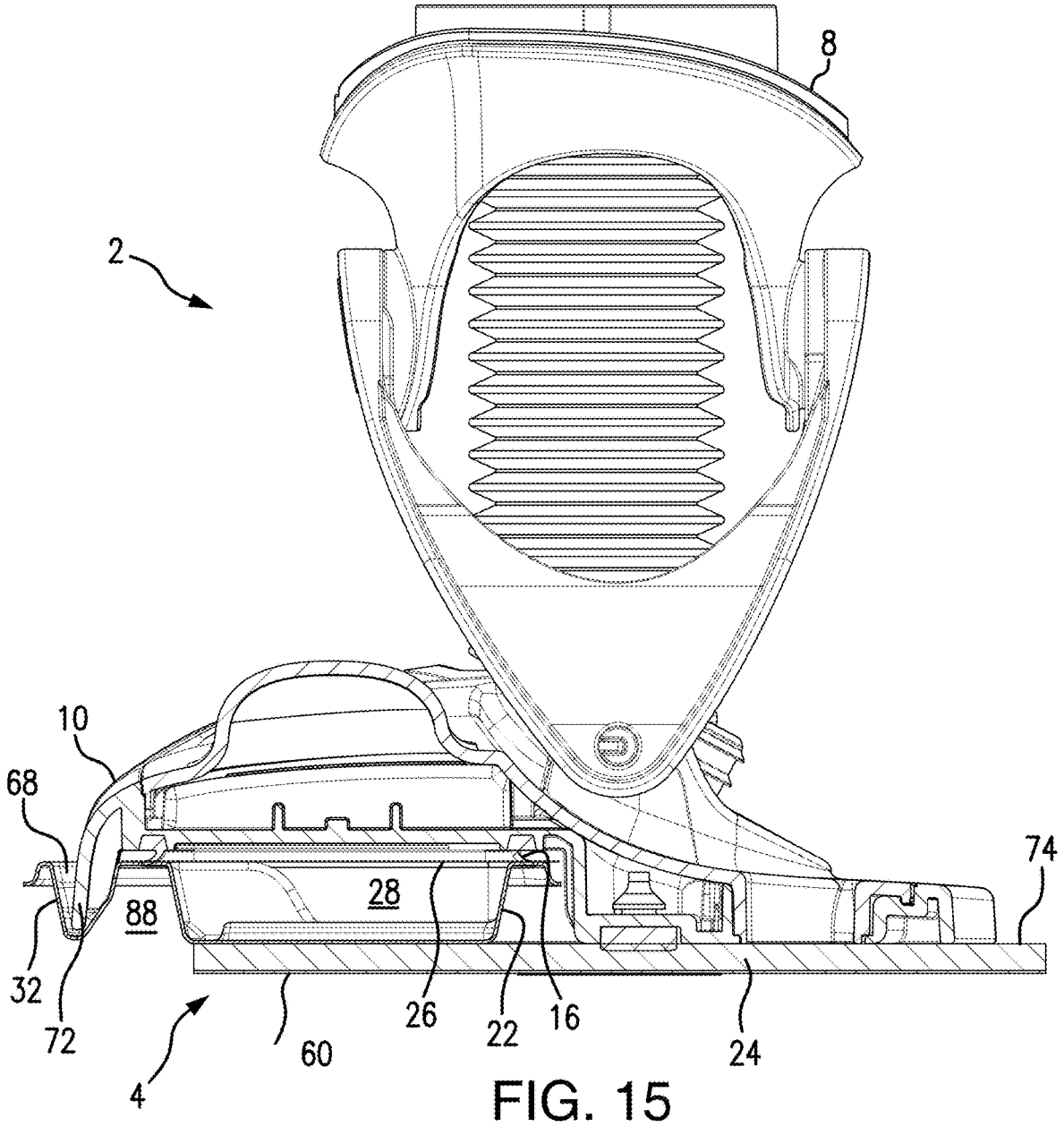
FIG. 15 shows a cross-sectional view of FIG. 1 along line 15-15 depicting the interaction between the vacuum head and the front guard of the plastic tray.

Referring to FIGS. 7-11 and 13, the first connector lip 56 extends outwards from the left wall 40 of the dust chamber 28, outside of the sealing surface 30. Also, at least a portion of the first connector lip 56 is located between the front wall 36 and the rear wall 38 of the dust chamber, as shown, e.g., in FIG. 11. The first connector lip 56 includes a lower surface 58 that is located below the sealing surface 30. More particularly, and as shown in FIGS. 13 and 14, the lower surface 58 of the first connector lip 56 is located between the level of the sealing surface 30 and the second surface 60 of the pad 24 (described in greater detail below). Even more particularly, the lower surface 58 of the first connector lip 56, in some embodiments, is closer to the sealing surface 30 than the second surface 60 of the pad 24. The cross-sectional shape of the first connector lip 56 may be of any chosen by the designer. However, it is preferred, in order to increase rigidity and reduce material, that the first connector lip 56 has a cross-sectional shape that includes at least one curve. The actual relative positioning of the lower surface 58 of the first connector lip 56 should be complementary to the design of the of the vacuum head 10 and connector arms 18, 20. In the locked position, as shown in FIG. 3, the connector arms 18, 20 of the vacuum head engage with the lower surface 58 of the first connector lip 56. When held in position by the connector arms 18, 20 of the vacuum head 10, the sealing surface 30 of the replacement head 4 is engaged with, either directly or indirectly, vacuum sealing surface 16.

In some embodiments, and now referring to FIGS. 10 and 11, the first connector lip 56 may extend rearward of the rear wall 38 and/or further forward of the front wall 36. In even further embodiments, the first connector lip 56 may extend forward of the front guard 32 (described below). The first connector lip 56 may be formed integrally with the other features of the plastic tray 22 (e.g., the dust chamber), or may be a separate element that is combined with the remaining features of the plastic tray 22 prior to end use.

Referring to FIGS. 7-11 and 13, the second connector lip 62 extends outwards from the right wall 42 of the dust chamber 28, outside of the sealing surface 30. Also, at least a portion of the second connector lip 62 is located between the front wall 36 and the rear wall 38 of the dust chamber 28, as shown, e.g., in FIGS. 10 and 11. Similar to the first connector lip 56 shown in FIGS. 13 and 14, the second connector lip 62 includes a lower surface 64 that is located below the level of the sealing surface 30 (see e.g., FIGS. 7 and 8). More particularly, the lower surface 64 of the second connector lip 62 is located between the level of the sealing surface 30 and the second surface 60 of the pad 24 (described in greater detail below). Even more particularly, the lower surface 64 of the second connector lip 62, in some embodiments, is closer to the sealing surface 30 than the second surface 60 of the pad 24. The cross-sectional shape of the second connector lip 62 may be of any chosen by the designer and may be the same as, or different than, the first connector lip 56. It is preferred that the second connector lip 62, for the same reasons stated above, has a cross-sectional shape that includes at least one curve. The relative positioning of the lower surface 64 of the second connector lip 62 should be set such that it is complementary to the design of the of the vacuum head 4 and connector arms 18, 20. In the locked position, as shown in FIG. 3, the connector arms 18, 20 of the vacuum head 4 engage with the lower surface 64 of the first connector lip 56. When held in position by the connector arms 18, 20 of the vacuum head, the sealing surface 30 of the replacement head 4 is engaged with, either directly or indirectly, vacuum sealing surface 16.

In some embodiments, and now referring to FIGS. 10 and 11, the second connector lip 62 may extend rearward of the rear wall 38 and/or further forward of the front wall 36. In even further embodiments, the second connector lip 62 may extend forward of the front guard 32 (described below). The second connector lip 62 may be formed integrally with the other features of the plastic tray 22 (e.g., the dust chamber 28), or may be a separate element that is combined with the remaining features of the plastic tray 28 prior to end use. In some embodiments, the first and second connector lips 56, 62 may be separate elements while, in other embodiments, such as the embodiment shown in, e.g., FIG. 6, the first and second connector lips 56, 62 may be interconnected across the front and/or rear of the plastic tray 22.

Referring now to FIGS. 5, 7, 9 and 10, the plastic tray 22 can include a front guard portion 32 that is located at least partially forward of the dust chamber 28. Preferably, the front guard portion 32 is located directly in front of the opening 52 and extends to a position outside of one or both sides of the opening 52. In the embodiment shown, the front guard portion 32 is located forward of the dust chamber 28 and defines a shaped bottom surface 66, an interior space 68 and extends generally from the right side of the plastic tray 22 to left side. The cross-sectional shape of the front guard 32 can be any suitable shape; however, a generally triangular cross-section (as shown in FIG. 9) has been shown to have particular utility. The lowest portion of the bottom surface 66 is preferably in close proximity to the floor being cleaned to assist in controlling the airflow into the dust chamber 28. In other words, the bottom surface 48 is closer to the second surface 60 of the pad than the sealing surface 30.

Figure 7:
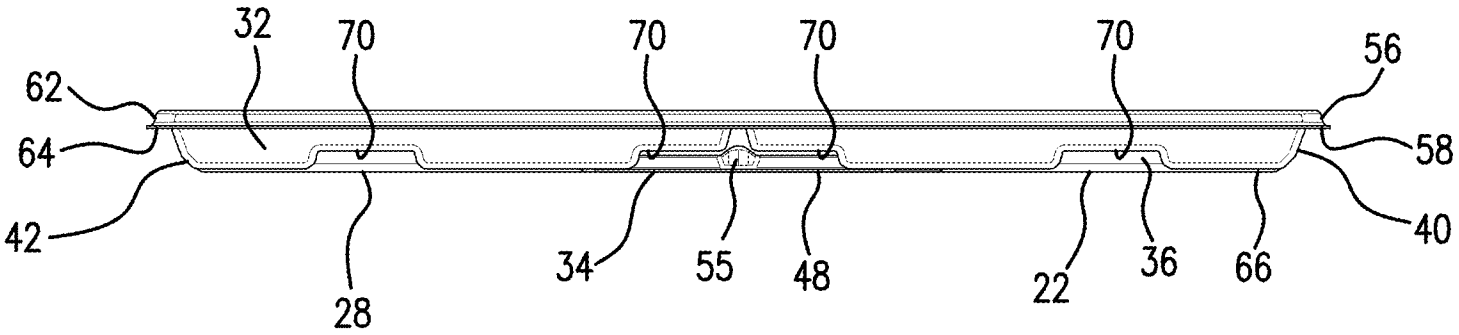
FIG. 7 shows a front view of the plastic tray of the present invention.
Figure 8:
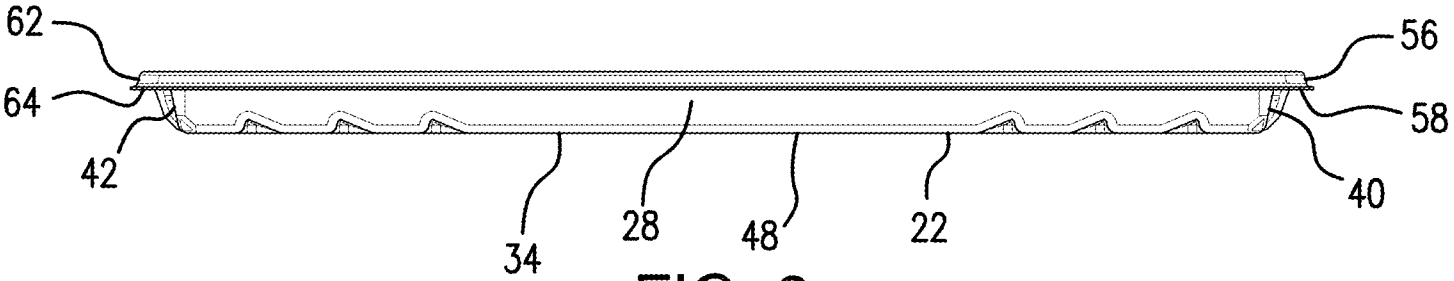
FIG. 8 shows a rear view of the plastic tray of the present invention.

In some embodiments, as shown in, e.g., FIGS. 5 and 7, it is preferable that the front guard 32 includes one or more castellations 70. While it is desirable for sections of the front guard 32 to be in close proximity to the ground during the cleaning process, the castellations 70 provide sections that permit larger pieces of debris (e.g., pieces of cereal) to come into close proximity to the opening 52 of the dust chamber 28 in order to be drawn into the dust chamber 28. Castellations can be located in any desired location on the front guard portion 32. Referring to, e.g., FIGS. 10-11, at least one castellation 70 is located directly in front of the opening 52. In addition, castellations 70, as also shown in FIGS. 10-11, can be located outside the outer edges of the opening 52.

Figure 17:
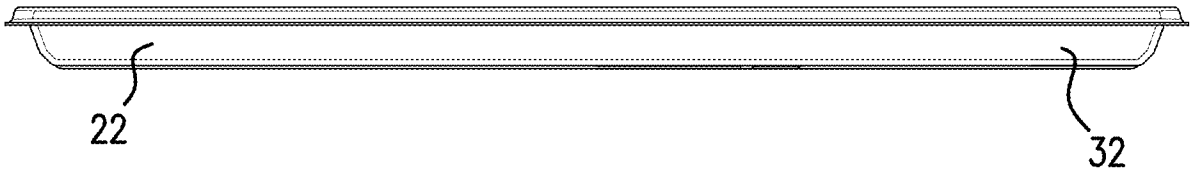
FIG. 17 shows a perspective view of the underside of the plastic tray in an embodiment where the front guard portion does not have castellations.

In other embodiments, such as the one shown in FIG. 17, the front guard portion 32 may not have any castellations 70. In this embodiment, the front guard portion 32 has a generally uniform shape along substantially the entire length.

The interior space 68 of the front guard 32, as shown in FIGS. 4 and 14, provides space to receive corresponding, complementary features 72 on the vacuum head 10. Preferably, the interior space 68 is located at an asymmetrical location on the plastic tray 22 such that, if the replacement head 4 were to be unintentionally reversed by the end user, the features on the front of the vacuum head 10 would contact plastic tray material (e.g., the sealing ring 30), thus cueing the end user that the replacement head 4 is being attached incorrectly. The vacuum head 10 may include a single feature that enters the interior space 68 of the front guard 32 during attachment, or, as shown in FIG. 3, may include multiple features.

The interior space 68 is generally located below the sealing surface 30 and adjacent the dust chamber 28. As shown in FIGS. 10-11, at least a portion of the sealing surface 30 extends between the interior space 68 and the top opening 46 of the dust chamber 28. As noted above, the interior space 68 may be generally triangular in shape. In these embodiments, the generally converging walls of the interior space 68 function to assist the user to position the vacuum head 10 into the proper attachment position by urging the vacuum head either slightly forwards or backwards during attachment.

Referring now to FIG. 9, the interior space 68 may have a partial vertical wall 86 on the side closer to the dust chamber 28. The partial vertical wall 86 can interact with features on the vacuum head 10 to prevent motion relative to the vacuum head 10 during a pull-back stroke.

Located between the front guard portion 32 and the dust chamber 28 is the front suction chamber 88. The front suction chamber 88 extends across the plastic tray 22 from side to side. The front suction chamber 88, as shown in FIG. 9, is bounded on the front by the rear side of the front guard portion 32 and at the rear by the front wall 36 of the dust chamber and the opening 52. The size and shape can be determined by the designer; however, it is preferable to shape the front suction chamber 88 in such a manner to encourage airflow to direct dust, dirt towards the opening(s) 52.

The filter 26 is made of a suitable material that will permit air to pass therethrough during use, yet block at least a substantial portion of the dust that is drawn into the dust chamber 28 during cleaning. In addition, it is desirable for the filter 26 to have the ability to absorb and/or block moisture prior to entering the vacuum device 2. It is desirable to choose a material that is inexpensive to manufacture, readily cut to size and easily attachable to the plastic tray 22. In the embodiment shown, the filter 26 is a non-woven, hydrophobic material made of SMS Polypropylene, 40 gsm. In embodiments where the filter material is printable, an additional printed pattern may appear on the filter 26 that includes, e.g., a logo or directions for use.

The filter 26 is attached to the plastic tray 22 such that substantially the entire top opening 46 is covered, as shown in FIG. 4. It is desirable that most, if not all, of the air that is drawn into the dust chamber 28 during vacuuming passes through the filter 26 prior to entering the vacuum device 2 so that the amount of dust, debris and moisture that enters into, and therefore can potentially damage, the suction source is minimized. The embodiment shown in FIG. 3, the filter 26 is attached to the sealing surface 30 such that, when the replacement head 4 is attached to the vacuum head 10, the filter 26 is sandwiched between the sealing surface 30 of the plastic tray 22 and the vacuum sealing surface 16. While it is desirable for the filter 26 to cover substantially all of the top opening 46 of the dust chamber 28, it is preferable that the filter 26 does not cover interior space 68 of the front guard 32 so that features 72 on the vacuum head 10 can enter into the interior space 68 of the front guard 32 unimpeded during attachment. The filter 26 may be attached to the plastic tray 22 in any acceptable manner. Suitable methods include using heat to bond the materials together, as well as the use of glues and adhesives. While it is preferable that the filter 26 is attached in a permanent manner to the plastic tray 22, other embodiments can have a removable connection. Even further embodiments can include an end user placing the filter 26 over the top opening 46 during use.

Figure 16:
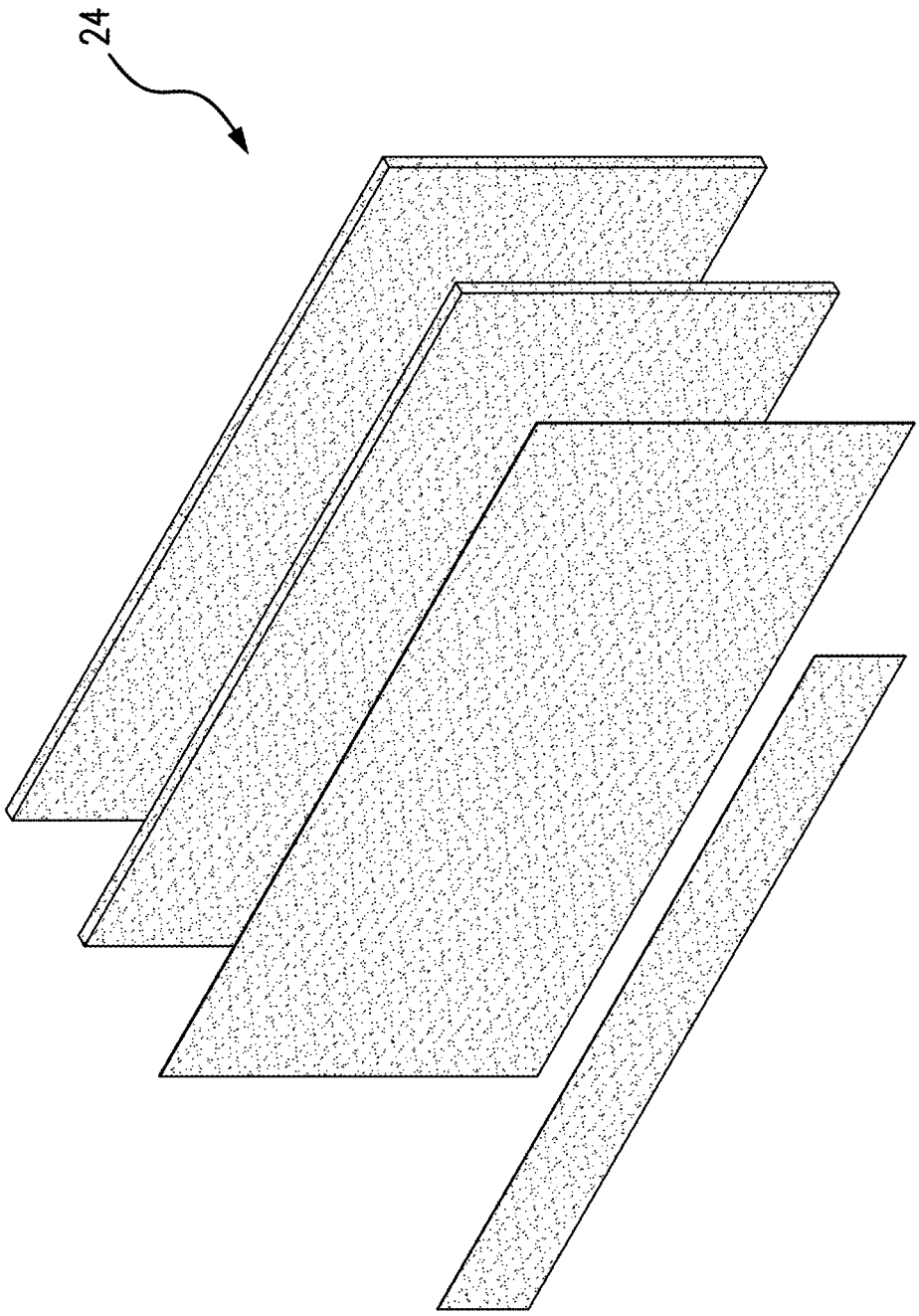
FIG. 16 shows an exploded view of one embodiment of the pad of the present invention.

The pad 24 includes a first surface 74 and a second surface 60 and is made from any suitable material that, preferably, can be used to scrub the surface being cleaned and/or absorb moisture. Pads 24 are well-known in the art and can include one or more layers. For example, a pad with a single layer made of 100% PET material or Carded Spunlace PET, 58 gsm; Spunbond PP, 10 gsm may be used. Or, as shown in FIG. 16, the pad 24 can include, e.g., four layers that each provide utility (e.g., absorption, retention, scrubbing). Exemplary layers include:

Layer 1: Air Laid Retention Layer; 180 gsm, 47% Pulp, 53% Bico

Layer 2: Air Laid Acquisition Layer; 100 gsm, 47% Pulp, 53% Bico

Layer 3: Face Layer; Carded Spunlace PET, 58 gsm; Spunbond PP, 10 gsm

Layer 4: Multi-function Strip; Melt Blown PP, 35 gsm

Referring to FIGS. 4 and 5, a multi-layer pad 24 is shown. In order to bond the various layers together, multiple methods are shown. In FIG. 5, the layers are ultrasonically welded together in a continuous manner along the entire edge. In certain embodiments, additional welds can be made in the body of the filter, as shown in a generally hexagonal pattern in FIG. 5. The continuous weld along the front and rear edges tends to provide a suitable bond between the layers to prevent delaminating. In FIG. 4, tack welding at localized positions along the front and rear edges is shown. In some embodiments, a total of about eight (8) weld locations are provided. In other embodiments, approximately about fifty (50) weld locations has been found to work suitably well. In addition, and still referring to FIG. 4, the spaced apart weld locations may be positioned along the edge of the pad 24. In other embodiments, as shown along the front edge of the pad in FIG. 4, the weld locations may be set back. By welding the layers together in localized positions, it has been shown that the welds maintain acceptable attachment between the layers, but allow for some expansion therebetween. The expansion between the welds has been found to permit additional absorption of liquids during use. For example, in some instances, where a continuously welded multi-layer pad might tend to push an amount of water that is on the floor either in front of or behind the vacuum device 2, an intermittently welded pad may absorb the liquid due to slight delamination that can occur between the welds. In embodiments where the welds are set back from the edge of the pad 24, localized delamination can be increased and, in certain circumstances, result in increased performance. The number of welds and location of the welds between the front and rear of the pad 24 can be the same, or different depending on the discretion of the designer.

The outer shape of the pad 24 can be any suitable known to one of skill in the art. As shown in FIG. 5, the pad 24 can be generally rectangular. The first surface 74 of the pad 24 is attached to the bottom surface 48 of the dust chamber 28 such that the second surface 60 of the pad 24 material is in contact with the floor during cleaning. Preferably, the first surface 74 of the pad 24 covers at least most of the bottom surface 48 of the dust chamber 28 and, even more preferably, covers the entirety. The pad 24 may extend outward from the bottom surface 48 of the dust chamber 28. As shown in FIGS. 4 and 5, the pad 24 extends rearward and to the sides of the bottom surface 48 of the plastic tray 28. Although it is acceptable for the pad 24 to extend forward of the front wall 36 of the dust chamber 28, such an arrangement has the potential to hinder usability by, e.g., blocking the opening 52 to the dust chamber 28 and/or the potentially causing the pad 24 to fold or buckle when the vacuum device 2 is pushed forward by the user during cleaning.

The pad 24 can be attached in any suitable manner. Preferably, the first surface 74 of the pad 24 is attached to the bottom surface 66 of the dust chamber 28 in a permanent manner. Suitable methods include using heat bonding or adhesives. Alternatively, the pad 24 can be replaceable and attached in a removable manner by, e.g., hook and loop fasteners.

Figure 12:
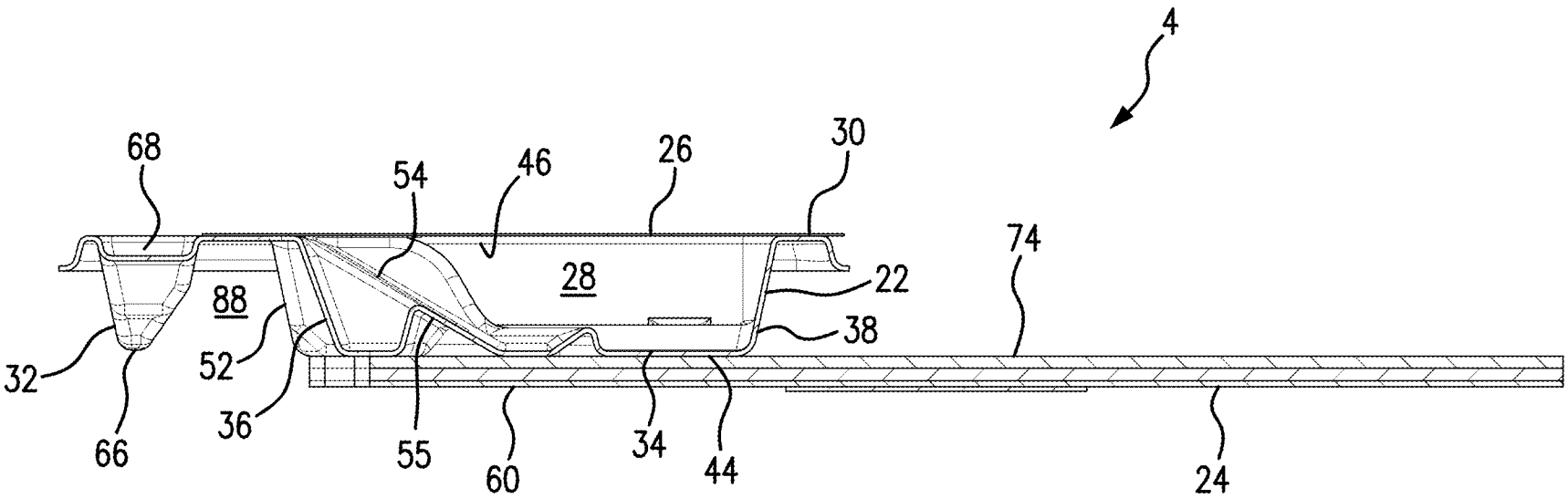
FIG. 12 shows a cross-sectional view of FIG. 4 along line 12-12 depicting the opening cover in a closed position.
Figure 12A:
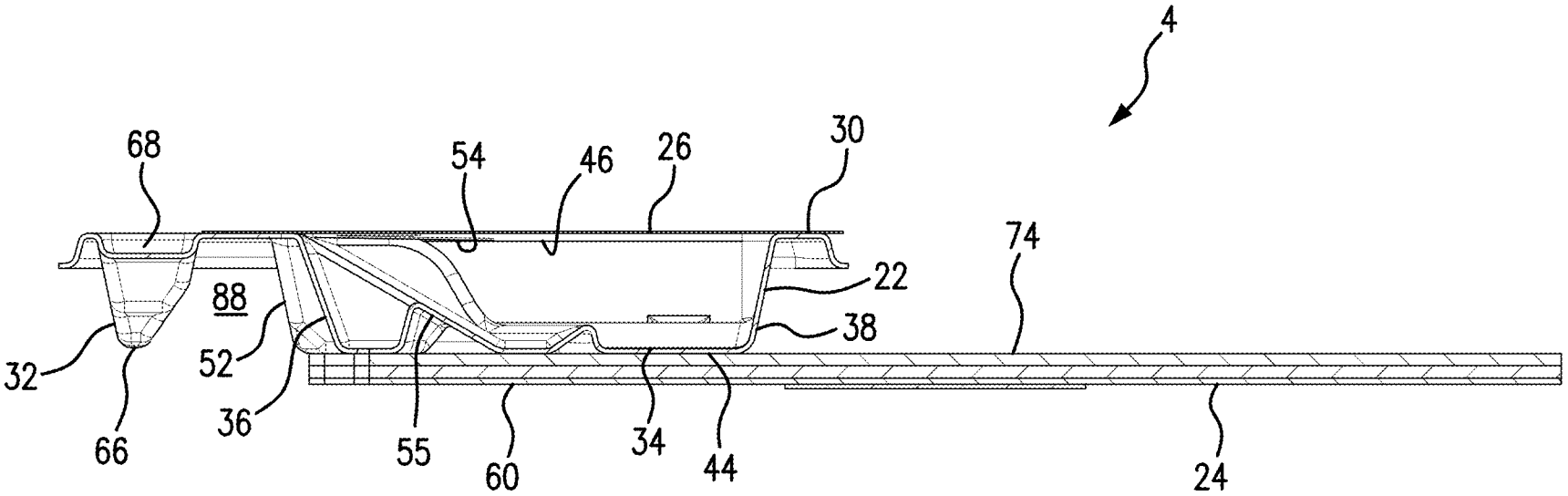
FIG. 12A shows a cross-sectional view of FIG. 4 along line 12A-12A depicting the opening cover in an open position.

In use, and now referring to FIGS. 1-3A, the end user moves at least one of the connector arms 18, 20 of the vacuum head 10 to the open position and places a replacement head 4 such that the filter 26 material is sandwiched between the sealing surface 30 of the plastic tray 22 and the vacuum sealing surface 16. The at least one connector arm 18, 20 is then released such that the connector arms engage the first and second connector lips 56, 62 on the plastic tray, holding the replacement head 4 in place for use. The user then activates the vacuum device 2, creating suction. The air drawn into the dust chamber 28 causes the opening cover 54 to move to an open position (as shown in FIG. 12A). As the user moves the vacuum device 2 and replacement head 4 over the floor to be cleaned, the suction source draws air, dirt and debris from the area in front of the replacement head 4 under the front guard 32, and through the opening 52 into the dust chamber 28. The air, dust and debris, once inside the dust chamber 28, are then drawn towards the filter 26 where the air passes through. The dust and debris are not able to pass through the filter 26 and are retained in the dust chamber 28. As desired, the user may activate the button 14 on the vacuum device 2 to spray fluid onto the floor in front of the replacement head 4. The user can then thoroughly clean the floor using the second surface 60 of the pad 24 to scrub the floor with cleaning fluid.

During the cleaning process, one or more of the following will occur: the dust chamber 28 will fill with dust and debris, the filter 26 will become clogged, and the pad 24 will become soiled. The user, at any time, may selectively replace the replacement head 4 by moving at least one of the connector arms 18, 20 to the open position, thereby releasing the first and second connector lips 56, 62 from engagement with the vacuum head 10. Advantageously, in the embodiment described, the user can replace the entire replacement head 4 all at once and replace with a refreshed replacement head 4 for future use with minimal mess.

Figure 18:
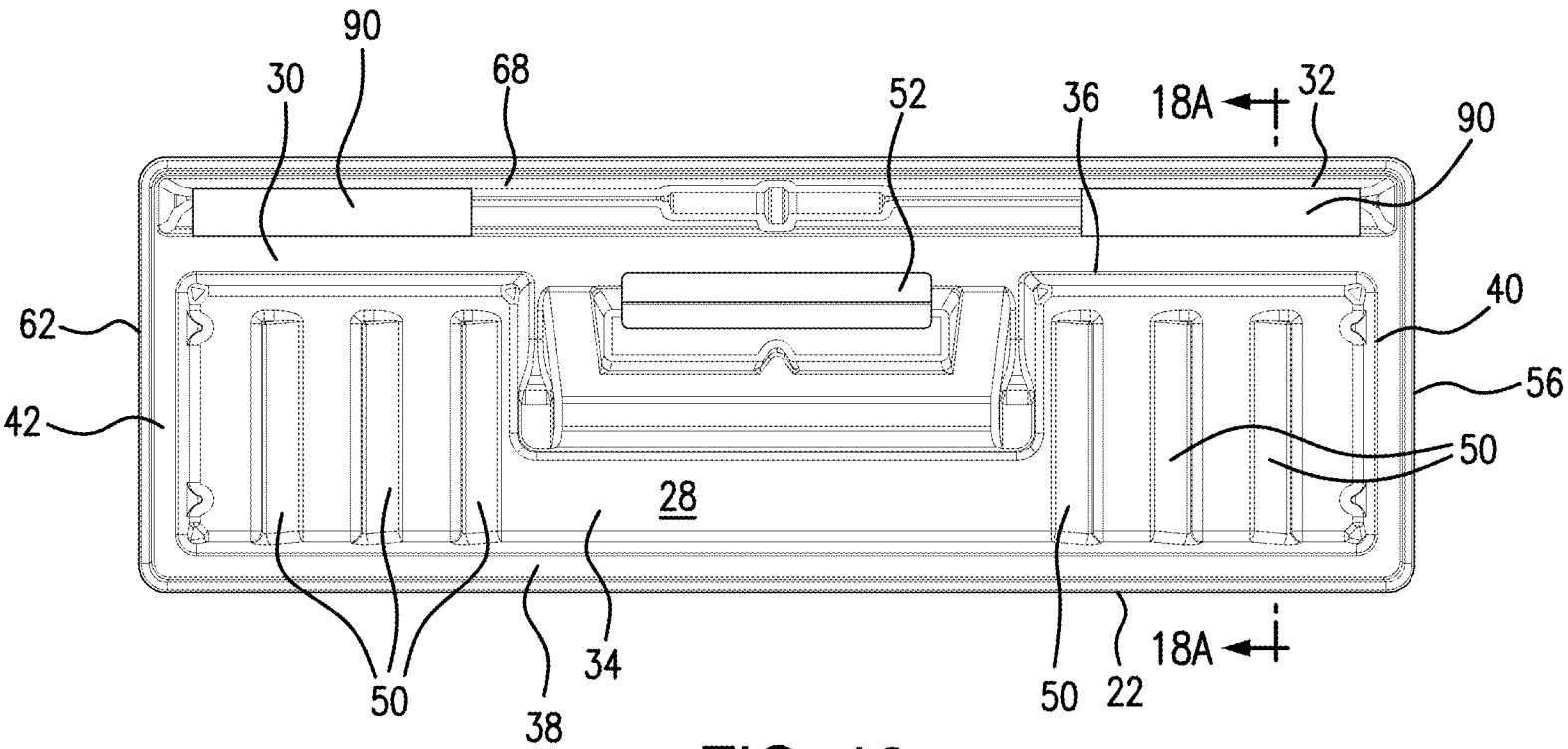
FIG. 18 shows a top view of one embodiment of the present invention where the front guard portion includes openings.
Figure 18A:
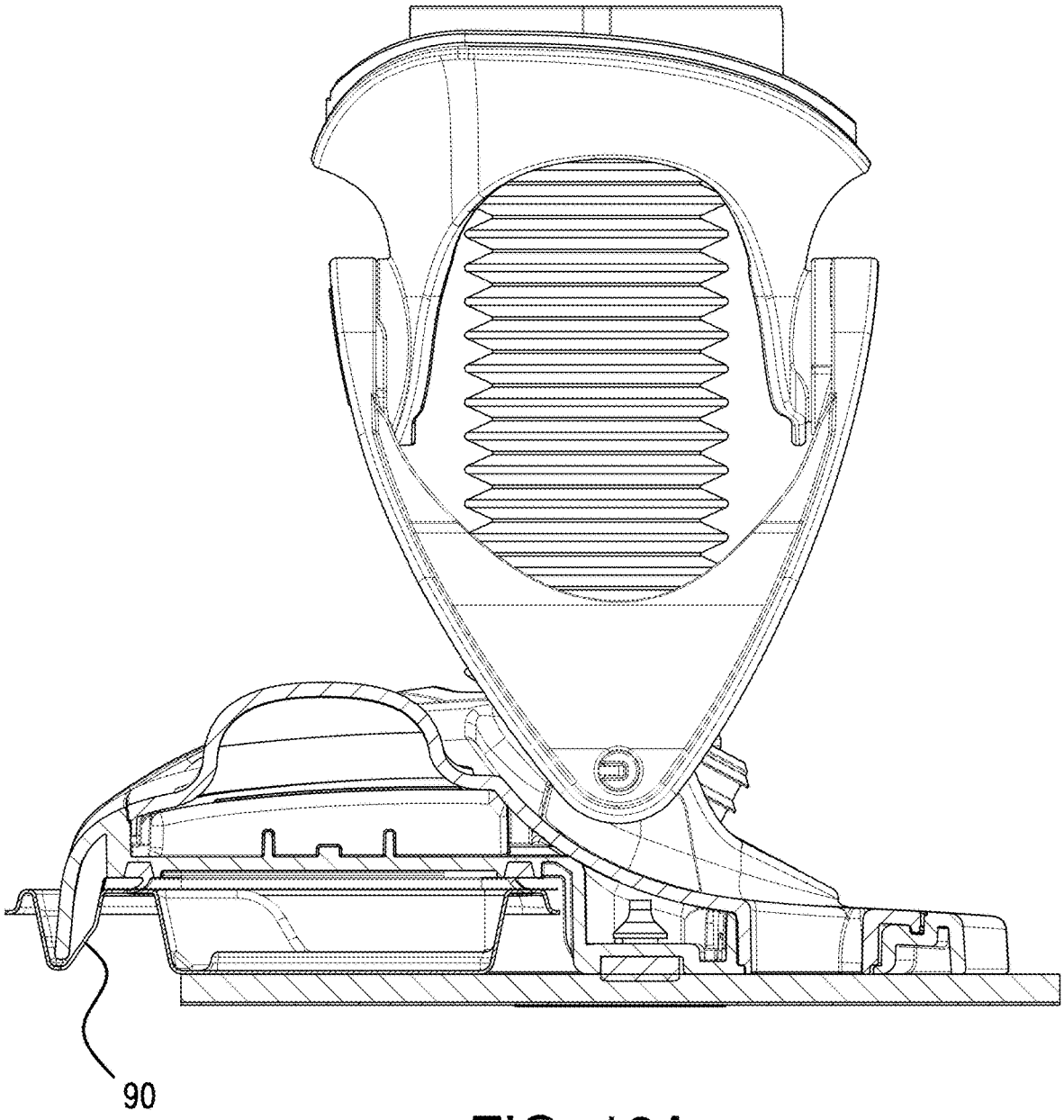
FIG. 18A is a cross-sectional view of FIG. 18 along line 18A-18A.

Referring now to FIGS. 18 and 18A, an alternative embodiment is shown where the front guard portion includes at least one opening 90. In this embodiment, rather than having a substantially enclosed interior space, the front guard has a front and bottom surface that is cantilevered from the plastic tray. In such an embodiment, the features from the vacuum head extend into the opening 90 to ensure proper orientation during use.

One of skill in the art would know that additional embodiments, or variations to the above description can be made without departing from the spirit or scope of the invention. In addition, the term about is used herein to describe a range of additional values known to one of skill in the art to be equivalent to the stated range. When the term about is used with regard to a range, the term is intended to apply to both ends of the range.

We claim:

1. A replacement head, comprising:

a tray that includes a dust chamber defining a first opening, the portion being configured to couple to a source of suction;

a second opening into the dust chamber separate from the first opening that permits debris to flow into the dust chamber;

a pad that is connected to the tray; and a filter connected to the tray such that the filter allows a suction force to be applied across the filter and through the first opening of the dust chamber while retaining debris within the dust chamber;

wherein the tray includes a front guard portion that has a bottom exterior surface that has a lowest point that is closer to the pad than the first opening;

wherein the second opening defines an upstream-most end of debris flow into the replacement head from a position exterior to the tray;

wherein the front guard portion is spaced from the second opening such that debris is intended to flow below the bottom exterior surface of the front guard portion prior to entering the replacement head through the second opening.

2. The replacement head of claim 1, wherein at least one portion of the front guard portion has a cross-sectional shape that is generally triangular.

3. The replacement head of claim 2, wherein all of the front guard portion has a cross-sectional shape that is generally triangular.

4. The replacement head of claim 1, wherein the front guard portion defines at least one interior space located below the first opening.

5. The replacement head of claim 1, wherein a sealing surface extends around the first opening, and at least a portion of the sealing surface extends between the front guard portion and the first opening.

6. The replacement head of claim 1, wherein the front guard portion extends in front of at least a portion of the second opening.

7. The replacement head of claim 6, wherein the second opening defines a first side and a second side, and wherein the front guard portion extends laterally to a position outside at least one side of the second opening.

8. The replacement head of claim 7, wherein the front guard portion extends laterally to a position outside of both of the first and second sides of the second opening.

9. The replacement head of claim 1, wherein the front guard portion includes at least one castellation.

10. The replacement head of claim 9, wherein the front guard portion includes at one castellation located directly in front of the second opening.

11. The replacement head of claim 10, wherein the front guard portion includes at least three castellations.

12. The replacement head of claim 9, wherein the front guard portion includes at least two castellations.

13. The replacement head of claim 1, wherein the front guard portion is integrally formed with the dust chamber.

14. The replacement head of claim 1, wherein the front guard portion includes at least one hole that extends through the front guard portion.

15. The replacement head of claim 1, wherein the front guard portion is located forward of the entire pad.

16. The replacement head of claim 1, wherein the front guard portion is located forward of the entire filter.

17. The replacement head of claim 1, wherein the front guard portion is located forward of the dust chamber.

18. The replacement head of claim 1, wherein a front suction chamber is located between the front guard portion and the second opening and is located at an exterior of the replacement head.

19. The replacement head of claim 1, wherein the pad includes at least a first and a second layer, the first and second layers of the pad being ultrasonically welded together.

20. The replacement head of claim 19, wherein the ultrasonic weld is generally continuous along at least one edge of the pad.

21. The replacement head of claim 19, wherein at least one edge of the pad has at least two localized weld locations that are spaced apart from one another.

22. The replacement head of claim 19, wherein an ultrasonic weld is positioned away from an edge of the pad.

23. The replacement head of claim 1, wherein the front guard portion defines an interior space that includes a wall that is at least partially vertical.

24. The replacement head of claim 23, wherein the wall that is at least partially vertical is located on a side of the interior space that is closest to the dust chamber.

25. A replacement head, comprising:

a tray that includes a dust chamber defining a first opening for allowing a suction force to be applied to the dust chamber, the tray including a sealing surface;

a second opening separate from the first opening that extends into the dust chamber;

a pad that is connected to the tray, the pad including a cleaning surface; and a filter connected to the tray and disposed relative to the first opening such that the filter allows a suction force to be applied through the filter to the dust chamber while retaining debris within the dust chamber;

wherein the tray includes a front guard portion that has a bottom surface that has a lowest point that is closer to the pad than the sealing surface;

wherein the second opening defines an upstream-most end of debris flow into the replacement head from a position exterior to the tray;

wherein the front guard portion includes a wall that at least partially defines an interior space, the interior space being separated from the dust chamber by at least a portion of the wall;

wherein a third opening extends into the interior space of the front guard portion from a position exterior to the replacement head, the third opening being generally open in a direction that faces away from the cleaning surface of the pad and is disposed forward of the dust bin.

26. A replacement head, comprising:

a tray that includes a dust chamber having a plurality of walls and defining a first opening for allowing a suction force to be applied to the dust chamber, the tray including a sealing surface;

a second opening that extends through at least one of the plurality of walls into the dust chamber;

a pad that is connected to the tray; and a filter connected to the tray and disposed relative to the first opening such that the filter allows a suction force to be applied through the filter and the first opening to the dust chamber while retaining debris within the dust chamber;

wherein the tray includes a front guard portion that has a bottom surface that has a lowest point that is closer to the pad than the sealing surface;

wherein the second opening defines an upstream-most end of debris flow into the replacement head from a position exterior to the tray;

wherein a front suction chamber is at least partially located between an exterior wall of the front guard portion and the second opening, the front suction chamber being located exterior the replacement head and positioned such that debris passes through the front suction chamber prior to entering the dust chamber through the second opening; and wherein at least a portion of the front suction chamber is forward of the second opening.

* * * * *